US005181471A

United States Patent [19]

Sillars

[11] Patent Number: 5,181,471

[45] Date of Patent: Jan. 26, 1993

[54] COMBINED OFFSET AND FLEXOGRAPHIC PRINTING AND DECORATING SYSTEM

[76] Inventor: Ian Sillars, 732 12th St., Manhattan Beach, Calif. 90266

[21] Appl. No.: 616,535

[22] Filed: Nov. 21, 1990

Related U.S. Application Data

[63] Continuation-in-part of Ser. No. 444,274, Dec. 1, 1989, abandoned, which is a continuation-in-part of Ser. No. 142,155, Jan. 11, 1988, Pat. No. 4,884,504.

[51] Int. Cl.[5] ..... B41F 17/22

[52] U.S. Cl. ..... 101/483; 101/217

[58] Field of Search ..... 101/40, 217, 483, 492, 101/376, 377

[56] References Cited

U.S. PATENT DOCUMENTS

| | | | |
|---|---|---|---|
| 1,379,365 | 5/1921 | Kirsch | 101/137 |
| 2,660,111 | 11/1953 | Herrick et al. | 101/91 |
| 3,889,596 | 6/1975 | Thomas et al. | 101/154 |
| 4,672,893 | 6/1987 | Mammarella | 101/153 |
| 4,884,504 | 12/1989 | Sillars | 101/76 |

FOREIGN PATENT DOCUMENTS 8901411 2/1989 World Int. Prop. O. .

*Primary Examiner*—Edgar S. Burr
*Assistant Examiner*—Ren Yan
*Attorney, Agent, or Firm*—Hecker & Harriman

[57] ABSTRACT

The present invention consists of a combined offset and flexographic printing apparatus. The preferred embodiment of the present invention provides apparatus for printing both quasi-random numbers and a plurality of different images on cylindrical objects. In this preferred embodiment, the invention consists of a cylindrical container printing and decorating press incorporating a blanket cylinder with a plurality of peripheral segments on which rubber offset blankets are mounted. A random number printing unit and a polygonal multi-image printing unit are provided between two segments of the blanket cylinder. Preferably, a plurality of random number/multi-image printing unit pairs are provided, one located between each pair of adjacent segments. A plurality of printing stations are arranged around the blanket cylinder, each featuring a master plate for transferring a single color image to the printing faces of the offset blankets, the random number printing units and the hexagonal multi-image printing units. The portion of the image transferred to the printing face of the offset blankets consists of the actual design being transferred to the printed objects. The resultant image transferred from the blanket cylinder to the object being printed is a combination of a pure offset image printed by the offset blankets of the printing cylinder together with flexographic images printed by the printing faces of the random number and hexagonal multi-image printing units.

13 Claims, 9 Drawing Sheets

COMBINED OFFSET AND FLEXOGRAPHIC PRINTING AND DECORATING SYSTEM

This is a continuation-in-part of U.S. patent application Ser. No. 444,274, filed Dec. 1, 1989, now abandoned, which is in turn a continuation-in-part of U.S. patent applicaton Ser. No. 142,155, filed Jan. 11, 1988, now U.S. Pat. No. 4,884,504, issued Dec. 5, 1989.

BACKGROUND OF THE INVENTION

1. Field of the Invention

The present invention relates to the field of printing, and more particularly to apparatus for printing designs and text on cylindrical objects.

2. Background Art

Two common printing techniques are "offset" and "flexographic" printing. Both of these techniques involve the transfer of an image from an engraved master printing plate onto another object.

In offset printing, the image is not transferred directly from the master plate to the printed object. Instead, the image is first transferred from the master plate to an intermediate blanket or roller. This intermediate blanket or roller is typically made of rubber or another resilient material, and has a flat surface that retains the ink deposited by the master plate. From the intermediate blanket or roller, the image is transferred to the printed object. The resilient surface provided by the intermediate blanket or roller conforms to surface irregularities of the object being printed and allows the printing of high quality images on many different textures. It protects the master plate from excessive wear as well.

In flexographic printing, the master printing plate itself is made from resilient rubber or plastic. The image can therefore be transferred directly from the master plate to the printed object with substantially the same benefits with respect to print quality provided by the intermediate blankets or rollers used in offset printing.

SUMMARY OF THE PRESENT INVENTION

The present invention consists of a combined offset and flexographic printing apparatus. It is a further development of the printing apparatus described in my granted U.S. Pat. Nos. 4,884,504 and 4,893,559, the specifications of which are incorporated herein by reference. U.S. Pat. No. 4,893,559 describes a multiple belt flexographic printing unit for printing quasi-random number tables. U.S. Pat. No. 4,884,504 describes a blanket cylinder type offset printing apparatus using the printing unit of U.S. Pat. No. 4,893,559 for printing quasi-random number tables on cylindrical objects such as drink cans. In an alternate embodiment of the invention described in U.S. Pat. No. 4,884,504, a flexographic belt containing a plurality of engraved images entrained about a rotating hexagonal printing plate cylinder is used to print of a variety of designs using a single blanket cylinder.

The preferred embodiment of the present invention provides apparatus for printing both quasi-random numbers and a plurality of different images on cylindrical objects. In this preferred embodiment, the invention consists of a cylindrical container printing and decorating press incorporating a blanket cylinder with a plurality of peripheral segments on which rubber offset blankets are mounted. A random number printing unit and a hexagonal multi-image printing unit are provided between two segments of the blanket cylinder. The random number printing unit and hexagonal multi-image printing unit are arranged with their imprinting faces aligned with the printing faces of the adjacent blankets. Preferably, a plurality of random number/multi-image printing units pairs are provided, one located between each pair of adjacent segments.

A plurality of printing stations are arranged around the blanket cylinder, each featuring a master plate for transferring a single color image to the printing faces of the offset blankets, the random number printing units and the hexagonal multi-image printing units. The portion of the image transferred to the printing face of the offset blankets consists of the actual design being transferred to the printed objects. The portions of the image transferred to the faces of the random number and hexagonal multi-image printing units, on the other hand, consist of blocks of ink that ink the engraved images contained on the flexographic belts or plates used in these units. The resultant image transferred from the blanket cylinder to the object being printed is a combination of a pure offset image printed by the offset blankets of the printing cylinder together with flexographic images printed by the printing faces of the random number and hexagonal multi-image printing units.

In an alternative embodiment of the present invention, instead of using a separate hexagonal multi-image printing unit to provide multiple images, the offset blankets mounted to the blanket cylinder themselves incorporate flexographic regions.

DETAILED DESCRIPTION OF THE PRESENT INVENTION

A combined offset and flexographic printing system is described. In the following description, numerous specific details, such as number of printing stations, number of belts, etc, are set forth in detail in order to provide a more thorough description of this invention. It will be apparent, however, to one skilled in the art, that the present invention may be practiced without these specific details. In other instances, well known features have not been described in detail so as not to unnecessarily obscure the present invention.

Figure 1:
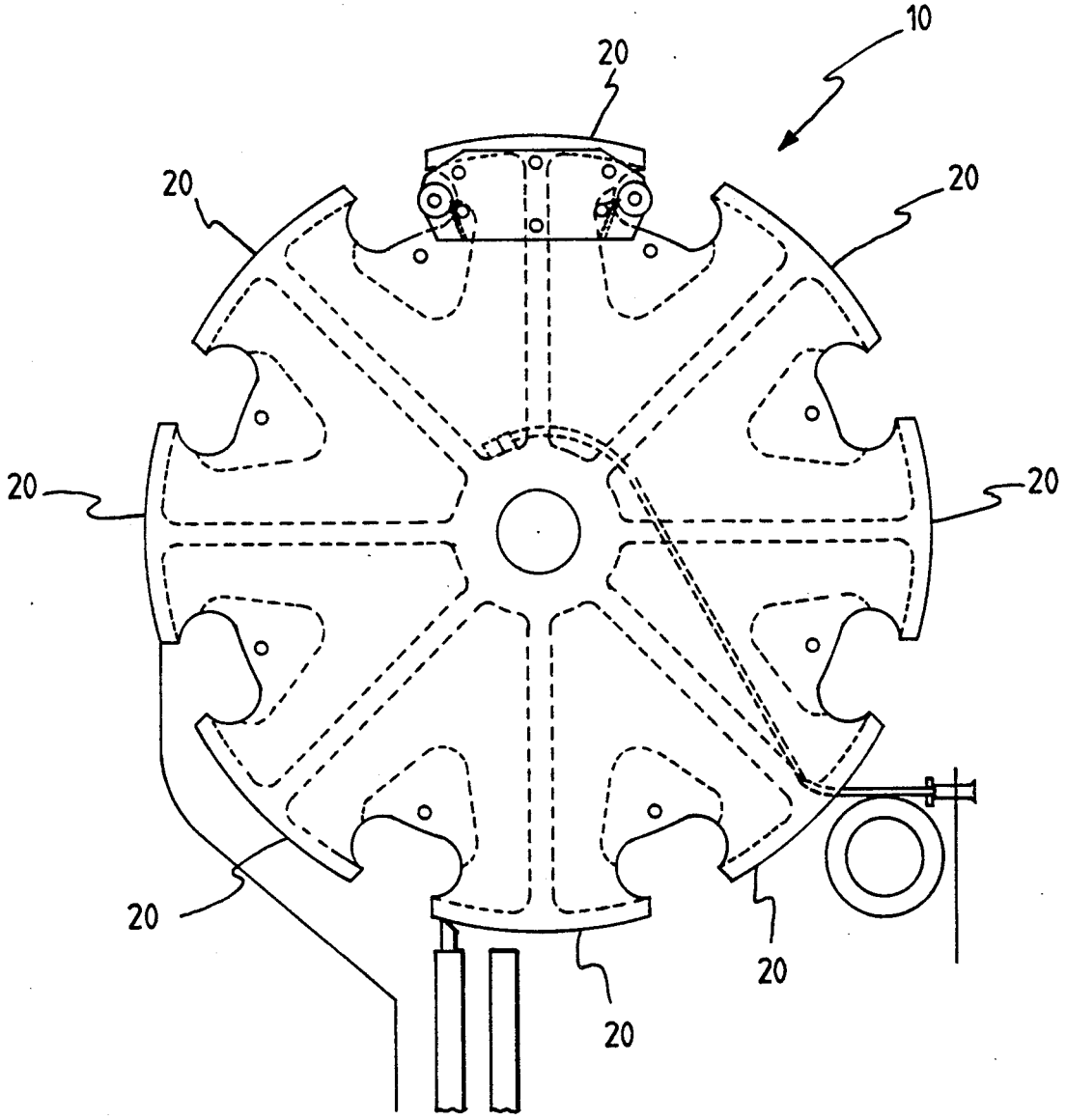
FIG. 1 (Prior Art)
FIG. 1 is a side view of a blanket cylinder of a conventional cylindrical container decorating press.
Figure 2:
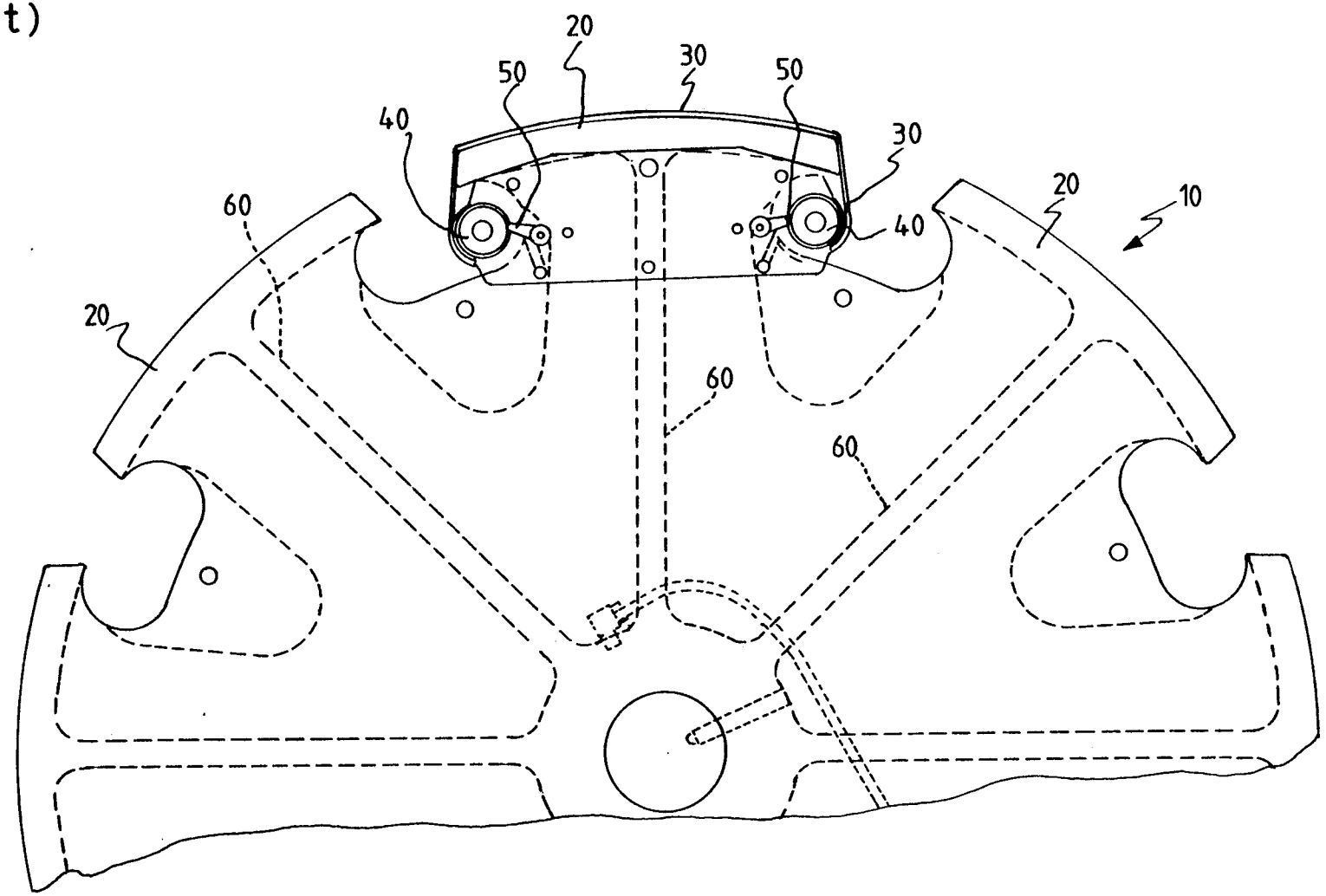
FIG. 2 (Prior Art)
FIG. 2 is an enlarged view of a section of the blanket cylinder shown in FIG. 1.

A typical cylindrical container decorating press has a blanket cylinder 10 of the type shown in FIGS. 1 and 2. Blanket cylinder 10 has a number of blanket segments 20 (typically eight segments as shown in FIG. 1) on each of which a rubber offset blanket 30 is mounted. The construction of the offset blanket can be more clearly seen in FIG. 2. Blanket 30 is tensioned over each segment 20 by means of tensioning rollers 40 and pawls 50 to secure blanket 30 in the desired location on the peripheral face of the segment.

In a typical can printing process, as each offset blanket passes each inking a unit color image is applied to the rubber offset blanket. Up to six different inking units applying six different colors are used. Depending on the precise design of the cylindrical container decorating press, the container to be printed is rotated against the blanket, whereby the six-color image is applied to the container. The container is subsequently varnished and dried.

The blanket cylinder is typically constructed of cast steel and is basically hollow except for the reinforcing splines 60 shown in FIGS. 1 and 2.

Figure 3:
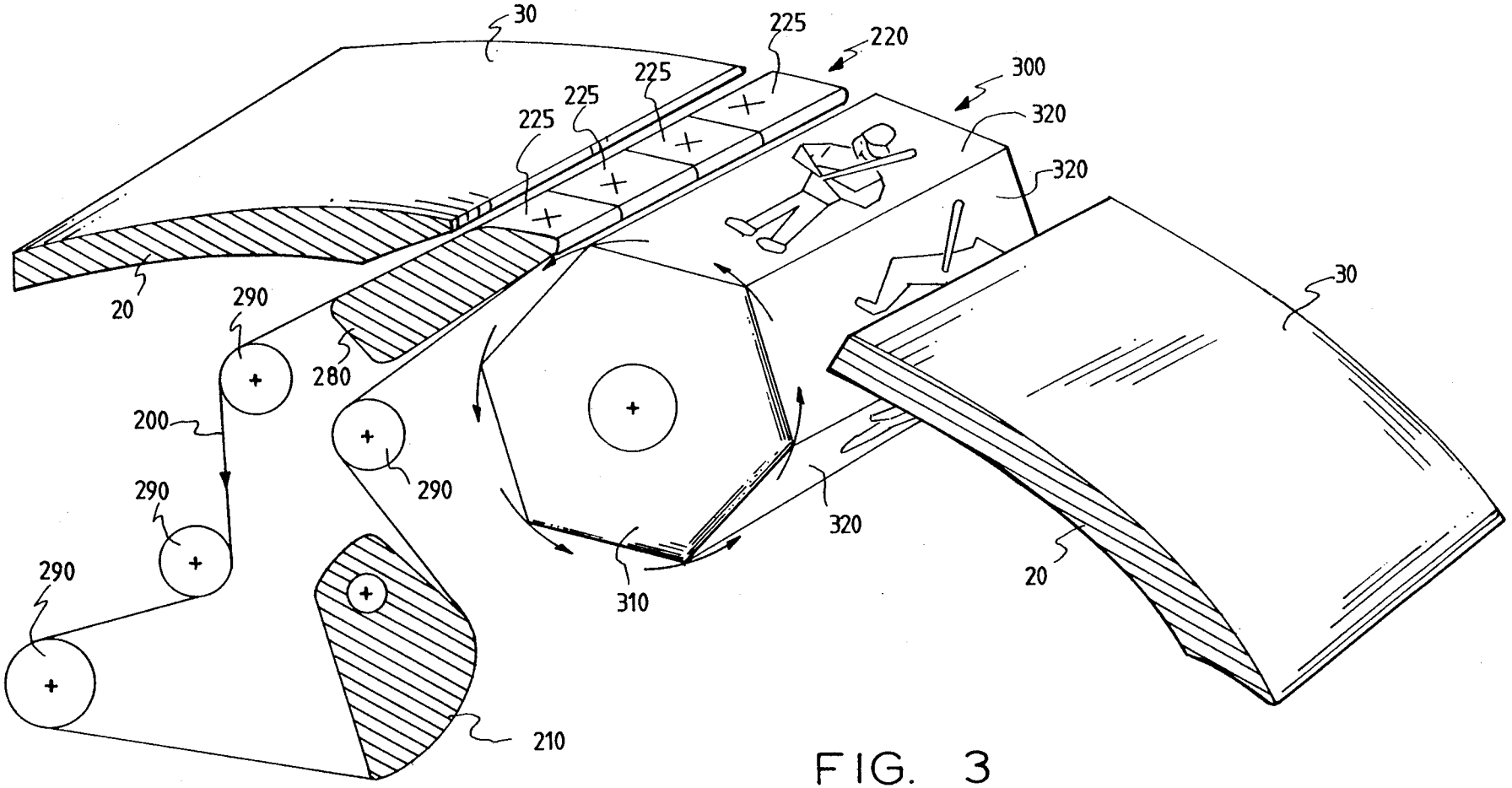
FIG. 3 an enlarged perspective view of a section of a blanket cylinder incorporating a random number printing unit and a polygonal multi-image printing unit according to the present invention.

The preferred embodiment of the present invention is shown in FIG. 3. According to this embodiment, a random number printing unit 220 and a polygonal multi-image printing unit 300 are inserted into blanket cylinder 10 between adjacent peripheral segments 20. Random number printing unit 220 and multi-image printing unit 300 are both aligned such that their respective imprinting faces are aligned with the imprinting faces of the offset blankets 30 mounted on the adjacent peripheral segments 20.

Figure 4:
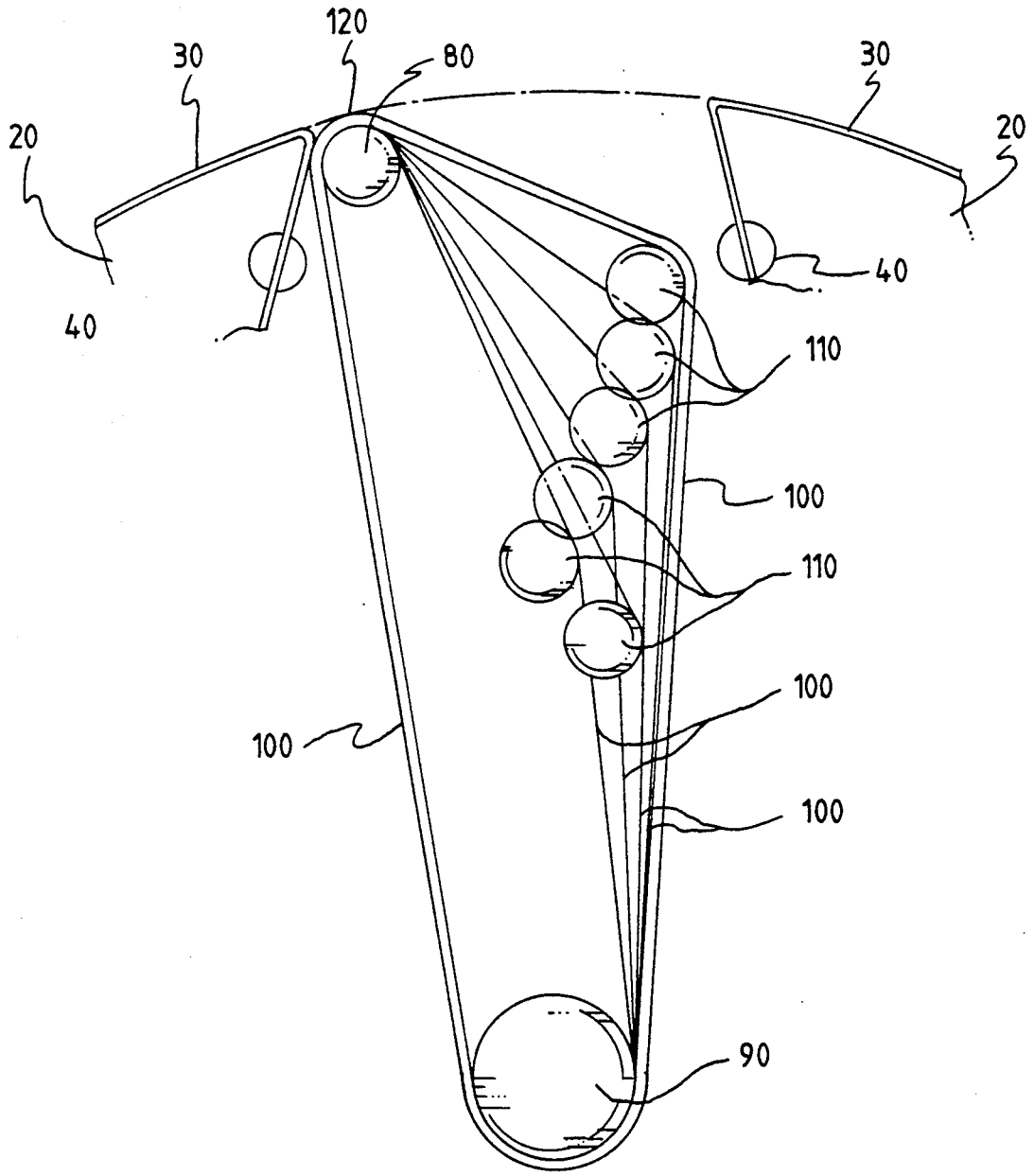
FIG. 4 (Prior Art)
FIG. 4 is a side view of an alternative embodiment of a random number printing unit incorporated into a blanket cylinder.

Random number printing unit 200 is a modification of the random number printing unit described in my issue U.S. Pat. No. 4,884,504 entitled METHOD FOR PRINTING OF QUASI RANDOM NUMBER TABLES ON CYLINDRICAL OBJECTS. This random number printing unit 120 from my earlier patent is shown in FIG. 4. Random number printing unit 120 consists basically of an elongated printing plate roller 80 and an elongated idler 90 about which a plurality of belts 100 are entrained. Each belt 100 has a different length which is a multiple of a basic pitch value or gradient and has a plurality of flexographic printing plates adhered to its outer surface. Each belt 100 is maintained in tension by its own tensioning roller 100. The different tensioning rollers 110 are positioned in different locations due to the different length of belts 100. Belts 100 have internal transverse teeth incorporated in the belt design, and printing plate roller 80 incorporates gear teeth which mesh with the internal teeth of the belts 100 to keep belts 100 in register as they pass over printing plate roller 80.

Printing plate roller 80 is driven by a cam drive which rotates the roller 80, and hence advances each of the belts 100, the gradient length or value between the successive printing plates mounted on its outer surface. The plates attached to the belts typically incorporate number segments which continuously change in register with one another, so that the entire number printed during each printing operation is constantly changing in a random number fashion.

The random number printing unit 220 shown in FIG. 3, though utilizing the same basic design concepts as random number printing unit 120 in FIG. 4, differs from random number printing unit 120 in several respects. In order to achieve a more compact design, the belts 200 of random number printing unit 220 follow a more complex folded path rather than the simple triangular path of belts 100 in FIG. 4. To maintain this folded path four idler rollers 290 instead of the single roller 90 are used. One of the rollers 290 is driven by a can drive that rotates the roller, and accordingly advances each of the belts, by the gradient length or value between printing operations. This roller also preferably has geared teeth that mesh with the internal teeth in all the belts to keep them in proper register.

In addition, a printing face base plate 280 is used instead of printing plate roller 80 to provide the support for the printing faces 225 of belts 200. Also, tensioning cams 210 are used instead of tensioning rollers 110 to maintain tension in each of the belts 200. Printing face base plate 280 and tensioning cams 210 are preferably made of [cast steel] and have a smooth, polished, low friction surface where they are in contact with belts 200.

Printing face plate 280 is used because it provides a printing face whose radius of curvature matches the curvature of the adjacent segments 20 of the blanket cylinder. As shown in FIG. 4, the printing face provided by printing plate roller 80 has a much smaller radius of curvature than the printing faces of adjacent segments 20. This small limits the effective size of the usable printing surface and can lead to distortion of the printed image.

Tensioning cam 210 has a greater radius of curvature than the tensioning rollers 110 used in the embodiment of FIG. 4. Tensioning cam 210 can therefore provide a greater amount of adjustment in the tension of belt 200 than could be provided by a tensioning roller 110.

As shown in FIG. 3, multi-image printing unit 300 preferably consists of a polygonal cylinder 310 each face of which incorporates a flexographic printing plate 320. Polygonal cylinder 310 may have any desired number of faces. In the embodiment shown, a hexagonal cylinder is used. The images engraved on the flexographic plates 320 of polygonal cylinder 310 are preferably variations of a single theme. For instance, the flexographic plates 320 shown in FIG. 3 all represent baseball figures. Polygonal cylinder 310 can be rotated so that each of the flexographic plates 320 can be successively presented as a printing face. This rotation must occur during the portion of the blanket cylinder's rotation between the printing station (where the cylindrical objects 510 are printed) and the first inking station (where the first color of ink is applied). In the preferred embodiment, this rotation to the next suceeding face occurs within an angle of 30 degrees from the printing station. A cam driven indexing mechanism is preferably used to provide the necessary rotation.

The blanket cylinder 10 shown in FIG. 1 has eight spaces between peripheral segments 20 that are potential sites for mounting a multi-image printing unit 300. If all eight spaces are used, eight hexagonal cylinders 310 would allow the printing of 48 different images. Polygonal cylinders 310 are preferably removable and interchangeable. The number of peripheral segments may be greater than eight depending on the application.

Figure 5:
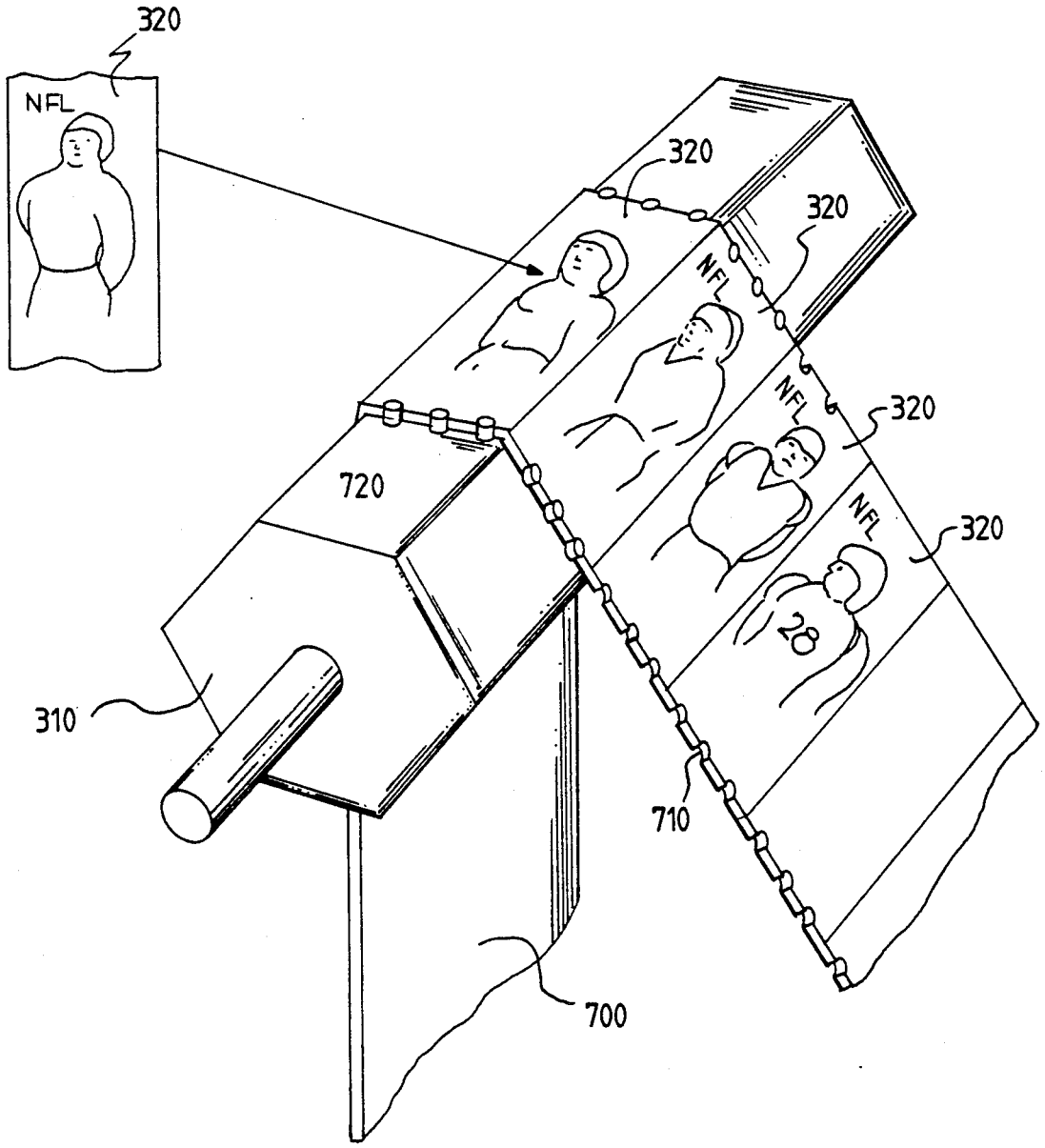
FIG. 5 is a perspective view of an alternative embodiment of the polygonal multi-image printing unit of the present invention.

An alternative embodiment of the multi-image printing unit of the present invention that allows the printing of an even greater number of different images is shown in FIG. 5. In this embodiment, rather than being mounted directly onto polygonal cylinder 310, flexographic printing plates 320 are mounted on a flexible belt 700, similar to the belts 200 of random number printing unit 220. Preferably flexible belt 700 contains edge perforations 710 that mate with protrusions 720 on polygonal cylinder 310 to insure proper registration of printing plates 320. A tension roller or cam (not shown) is used to maintain tension in flexible belt 700.

Inking and printing operations using the random number printing unit and multi-image printing unit of the present invention will be described with reference to FIGS. 7A to 9.

Figure 7A:
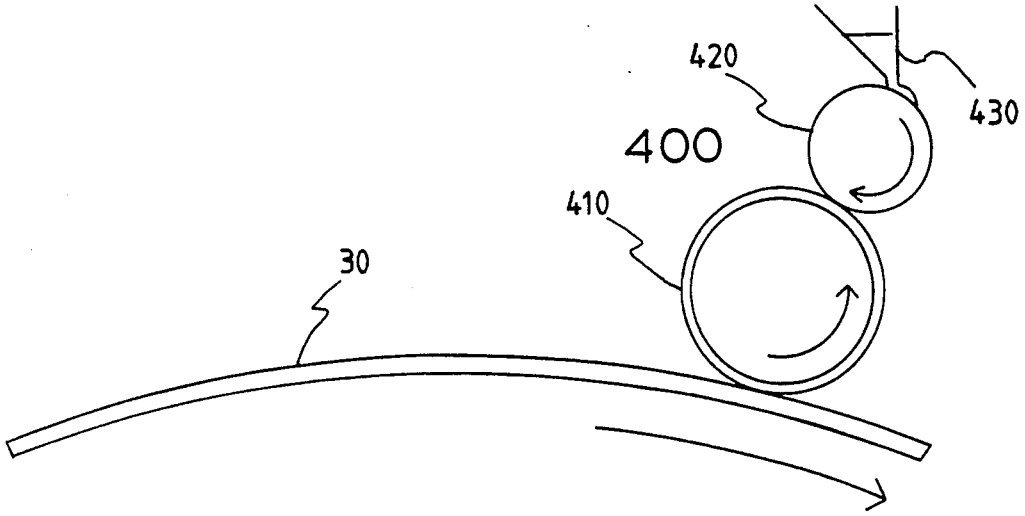
FIG. 7A (Prior Art)
FIG. 7A is a side diagrammatic view illustrating the inking of a segment of a blanket cylinder of the prior art.
Figure 7B:
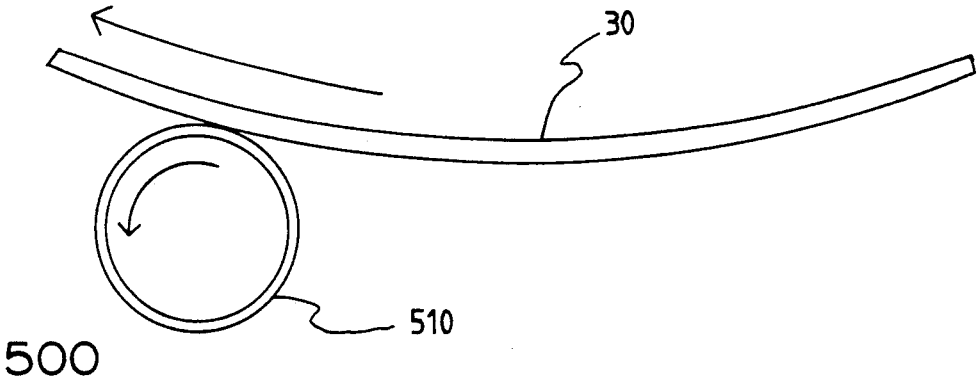
FIG. 7B (Prior Art)
FIG. 7B is a side diagrammatic view illustrating the printing of a cylindrical object with the segment of blanket cylinder of FIG. 7A.

FIGS. 7A and 7B diagrammatically illustrate the inking of and printing with a blanket cylinder incorporating rubber offset blankets of the prior art. FIG. 7A shows a rubber offset blanket 30 mounted on a blanket cylinder of the prior art being rotated past an inking unit 400. Inking unit 400 consists of an ink reservior 430, an inking roller 420, and an offset printing plate cylinder 410. Offset printing plate cylinder 410 is engraved with the image that is being printed. Ink from the ink reservoir 430 is fed to inking roller 420. Inking roller 420 spreads out the ink and distributes the ink to offset printing plate cylinder 410 (although only one inking roller 420 is shown in FIG. 7A, additional inking rollers may be used to provide more even distribution of the ink). As rubber offset blanket 30 moves past offset printing plate cylinder 410, the image engraved on offset printing plate cylinder 410 is "printed" onto the surface of rubber offset blanket 30.

As the blanket cylinder continues to rotate, rubber offset blanket 30 may rotate past additional printing stations (if more than one color is being used) and eventually arrives at printing station 500, shown diagrammatically in FIG. 7B. At printing station 500, cylindrical object 510 is rotated against blanket 30 as blanket 30 rotates past printing station 500. In the process, the ink image printed onto blanket 30 by printing station 400 is transferred onto cylindrical object 510. After cylindrical object 510 has been printed, a carousel-like mechanism rotates cylindrical object 510 out of the way. A blank cylindrical object is moved into place, ready to be printed upon by the next succeeding rubber offset blanket 30.

Figure 8A:
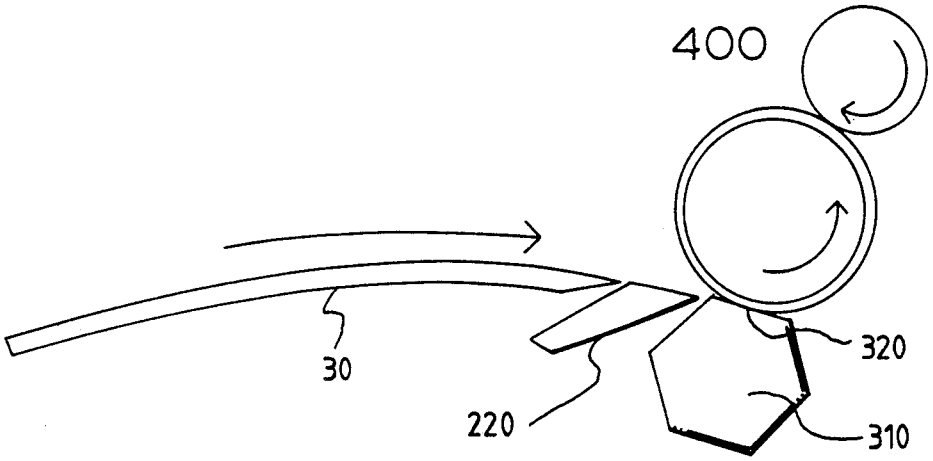
FIG. 8A is a side diagrammatic view illustrating the inking of a segment of a blanket cylinder of the present invention.
Figure 8B:
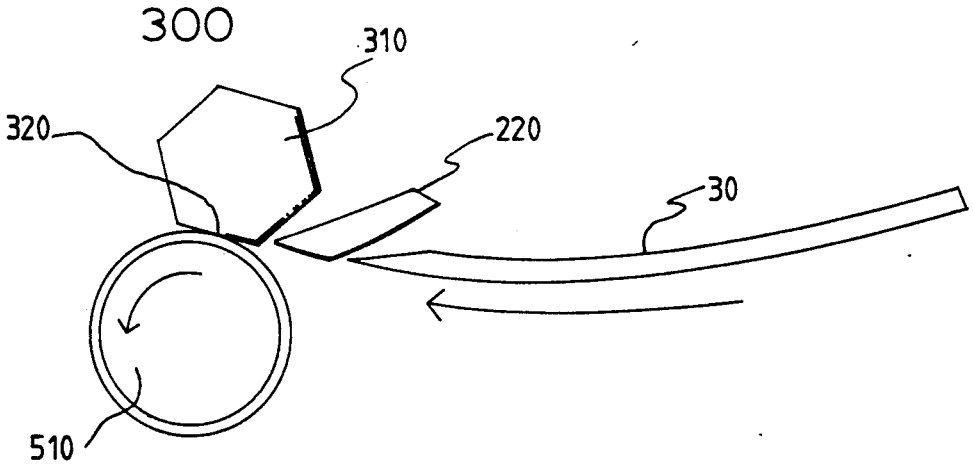
FIG. 8B is a side diagrammatic view illustrating the printing of a cylindrical object with the segment of blanket cylinder of FIG. 8A.

As shown in FIGS. 8A and 8B, inking and printing operations for the blanket cylinder of the present invention are basically the same as for the blanket cylinder of the prior art shown in FIGS. 7A and 7B. The main difference is found in the inking operation. In addition to depositing an ink image onto offset blanket 30 (as was done in the prior art process shown in FIGS. 7A and 7B), inking unit 400 in this case also deposits ink onto the printing faces of random number printing unit 220 and multi-image printing unit 300, respectively. Since the printing faces of random number printing unit 220 and of multi-image printing unit 300 consist of engraved flexographic plates rather than a flat rubber offset blanket, however, ink is not transferred to these plates in the form of an image but rather in the form of blocked areas of ink. These blocked areas of ink act as inking rollers that deposit ink on the raised portions of the engraved surfaces of the flexographic plates.

During the printing operation shown in FIG. 8B, a three-part image is printed onto cylindrical object 510. The first part consists of the image engraved on flexographic plate 320 of polygonal cylinder 310 of multi-image printing unit 300. The second part consists of the current pattern of numbers contained on the printing faces of belts 200 of random number printing unit 220. And the third image consists of the ink image previously printed by inking unit 400 onto rubber offset blanket 30.

FIGS. 9A to 9E show how multiple inking stations can be used to create multicolored three-part images using the present invention. In this example, three different inking stations are used: one brown, one red, one black.

Figure 9A:
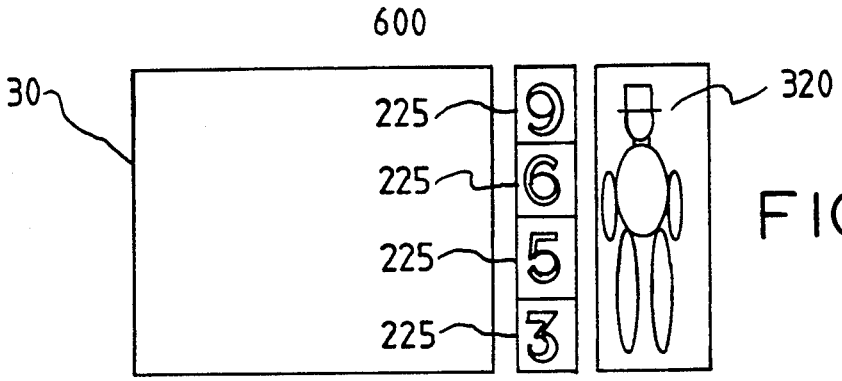
FIGS. 9A–9E are a top view showing examples of images transferred to the blanket cylinder of the present invention by three different colored printing stations.

FIG. 9A is a top view of one configuration of the printing face 600 of the blanket cylinder of the present invention. The printing face 600 shown in FIG. 9A consists of rubber offset blanket 30, four engraved flexographic printing faces 225 of random number printing unit 220 (each containing a number engraved thereon), and an engraved flexographic printing plate 320 of multi-image printing unit 300 (containing the engraved ingraved image of a man in a top hat). The combination of these three printing surfaces will form the image that is printed onto cylindrical object 510.

Figure 9B:
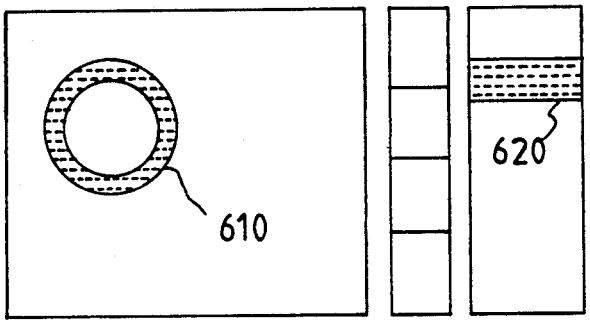
Figure 9C:
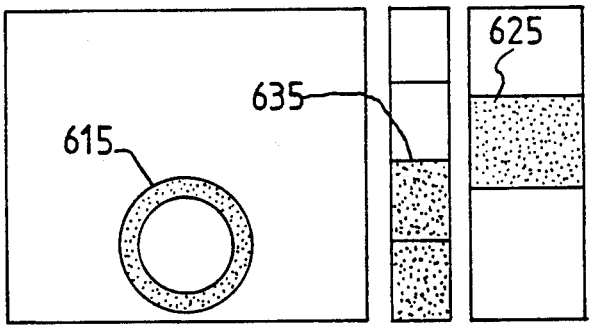
Figure 9D:
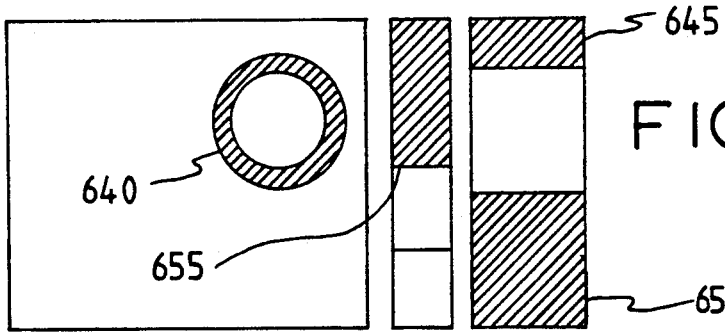

FIGS. 9B, 9C and 9D show the ink pattens that are deposited onto printing face 600 by the brown, red and black printing stations, respectively.

As shown in FIG. 9B, the brown inking station deposits an image of a ring 610 onto offset blanket 30, nothing onto random number printing faces 225, and a thin band of ink 620 onto multi-image flexographic plate 320. The thin band 620 is positioned so as to correspond with the position of the head of the image of the man engraved into flexographic plate 320. As a result the raised image of the head of flexographic plate 320 will be laden with brown ink, and accordingly a brown head will be printed onto the object being printed.

The inking pattern deposited by the next inking station, which uses red ink, is shown in FIG. 9C. The red inking pattern, like the brown inking patten shown in FIG. 9B, consists of the image of a ring 615 deposited onto offset blanket 30 and a band of ink 625 deposited onto flexographic plate 320. The red band 625, however, is located in the position corresponding to the midsection, rather than the face, of the image of the man engraved into flexographic plate 320. In addition, a second band of ink 635 is deposited onto the lower two random number printing faces 225. As a result, the numbers engraved onto these two printing faces will be printed in red onto the object being printed.

The inking pattern of the black inking station is shown in FIG. 9D. It consists of a image of a ring 640 deposited onto offset blanket 320, first and second bands 645 and 650 corresponding to the hat and the legs of the image of the man engraved on flexographic plate 320, and a third band 655 corresponding to the top two printing faces 225.

Figure 9E:
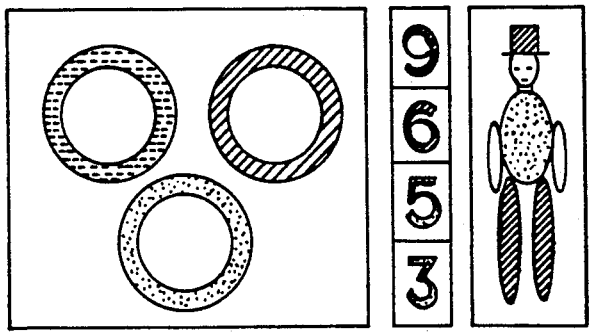

The resulting three-color, three-part image printed that will be transferred onto the object being printed is shown in FIG. 9E.

On the next revolution of the blanket cylinder, the belts of random number printing unit 220 will have advanced, and polygonal cylinder 310 of multi-image printing unit 300 will have rotated, such that a new set of printing faces 225 and a new flexographic plate 320 will be included in printing face 600. The inking patterns of the three inking stations will however be the same. The same band of color shown in FIGS. 9B, 9C and 9D will be transferred onto flexographic plate 320. As a result, the portions of the images engraved on flexographic plate 320 that correspond to the different bands of color deposited by the inking stations will be printed in the respective colors of the bands. By carefully designing and laying out he images engraved on flexographic plate 320 such that appropriate parts of the image fall into the respective color bands, a variety of three-color printed images can be obtained. More inking stations and more sophisticated coloring patterns that those shown in FIGS. 9B, 9C and 9D can be used to print more complex images.

Figure 6:
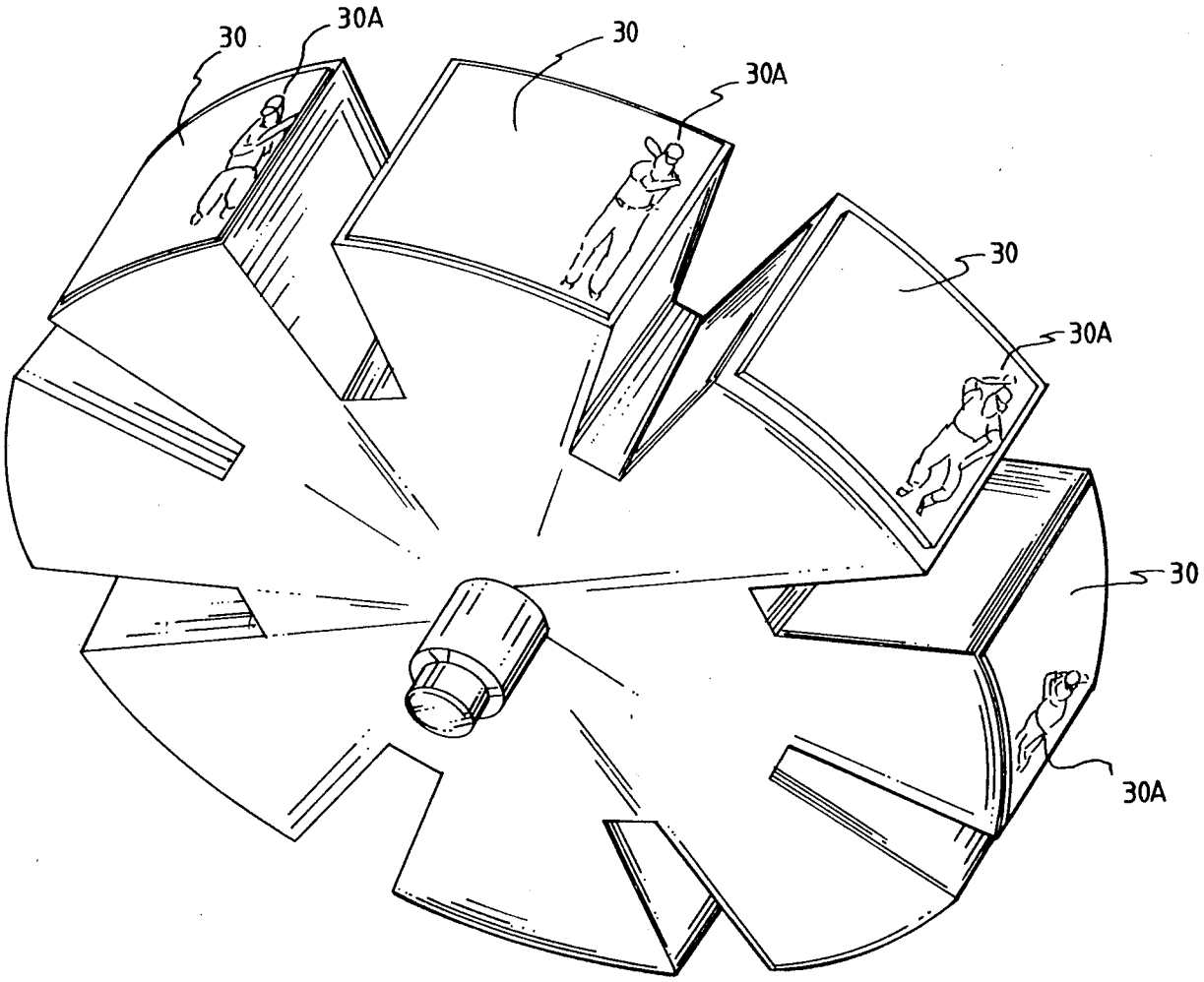
FIG. 6 is a perspective view of a blanket cylinder incorporating combination offset/flexographic blankets according to an alternate embodiment of the present invention.

An alternative embodiment of the combined flexographic/offset printing system of the present invention is shown in FIG. 6. In this embodiment, rather than using a separate multi-image printing unit, the blankets 30 themselves incorporate a flexographic regions 30A in which images are engraved. For a blanket cylinder with eight peripheral segments, this embodiment allows the printing of eight different images and is appropriate when only such a small number of different images is desired. This embodiment, as well as the previous embodiment of the multi-image printing unit of the present invention, may be used with or without random number printing unit 220.

I claim:

1. A method of simultaneously transferring multiple colored images onto cylindrical objects in a decorating press having a blanket cylinder comprising at least one peripheral printing face with a flexographic printing region comprising engraved patterns and an integral offset printing region comprising the steps of:

applying a first pattern of ink to said offset printing region, said first pattern comprising multiple colors;

applying a second pattern of ink to said flexographic printing region;

rotating a first cylinder against said blanket cylinder such that a portion of said first pattern is transferred from said offset printing region of said peripheral printing face to the cylinder and a portion of the engraved pattern of said flexographic region of said peripheral printing face is transferred to the cylinder.

2. The printing method of claim 1 further comprising the steps of:

applying said first pattern of ink to an offset printing region of a second peripheral printing face;

applying said second pattern of ink to a flexographic printing region of a second peripheral printing face;

rotating a second cylinder against said blanket cylinder such that a portion of said first pattern is transferred from said offset printing region of said second peripheral printing face to said second cylinder and a portion of the engraved pattern of said flexographic region of said second peripheral printing face is transferred to said second cylinder.

3. The printing method of claim 1 wherein said first and said second patterns of ink are applied in a single operation.

4. The printing method of claim 1 wherein said first and second patterns of ink each comprise a plurality of differently colored ink patterns.

5. The printing method of claim 4 wherein each color of ink is applied to said offset printing region and said flexographic region in a single operation.

6. A decorating press for simultaneously transferring multiple color images onto cylindrical objects comprising:

a blanket cylinder for simultaneously transferring multiple color images onto said cylindrical objects comprising at least two integral peripheral printing faces;

a first of said peripheral printing faces comprising an offset printing region;

a second of said peripheral printing faces disposed adjacent to said first peripheral printing face, said second peripheral printing face comprising a flexographic printing region comprising a printing plate means and a plurality of flexographic plates.

7. The decorating press of claim 6 wherein said offset printing region comprises a resilient printing blanket and said printing plate means comprises a rotatable polygonal cylinder.

8. The decorating press of claim 7 wherein certain of said flexographic plates are disposed up on the faces of said rotatable polygonal cylinder.

9. The decorating press of claim 7 wherein certain of said flexographic plates are disposed upon a belt, said belt disposed upon a first face of said rotatable polygonal cylinder.

10. The decorating press of claim 9 wherein said belt is entrained about said rotatable polygonal cylinder and a tensioning means.

11. The decorating press of claim 6 further comprising a random number printing unit comprising certain of said flexographic plates, said random number printing unit further comprising:

a printing plate means;

a plurality of belts disposed about the printing plate means;

a common idler roller disposed within the belts, and tension means for proving tension to said belts.

12. The decorating press of claim 11 wherein said offset printing region comprises a resilient printing blanket and said printing plate means comprises a rotatable polygonal cylinder and certain of said flexographic plates are disposed upon the faces of said rotatable polygonal cylinder.

13. A decorating press for printing upon cylindrical objects comprising:

a blanket cylinder comprising at least one peripheral printing face, said peripheral printing face comprising an offset printing region and an integral flexographic printing region disposed adjacent to said offset printing region;

a resilient blanket comprising said offset printing region and said flexographic region; and a random number printing unit comprising:

a printing plate means;

a plurality of belts disposed about the printing plate means;

a common idler roller disposed within the belts; and tension means for providing tension to said belts.

* * * * *